US009004256B2

(12) United States Patent
Ohara et al.

(10) Patent No.: US 9,004,256 B2
(45) Date of Patent: Apr. 14, 2015

(54) MEDIUM STORING DEVICE

(75) Inventors: Shinji Ohara, Tokyo (JP); Kei Iwatsuki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/127,072

(22) PCT Filed: Jul. 11, 2012

(86) PCT No.: PCT/JP2012/067648

§ 371 (c)(1),
(2), (4) Date: Dec. 17, 2013

(87) PCT Pub. No.: WO2013/054575

PCT Pub. Date: Apr. 18, 2013

(65) Prior Publication Data

US 2014/0262678 A1 Sep. 18, 2014

(30) Foreign Application Priority Data

Oct. 12, 2011 (JP) ..... 2011-224973

(51) Int. Cl.

| | |
|---|---|
| ***G07F 7/04*** | (2006.01) |
| ***G07D 11/00*** | (2006.01) |
| ***B65H 29/00*** | (2006.01) |

(52) U.S. Cl.

CPC ..... *G07D 11/0021* (2013.01); *G07D 11/0084* (2013.01); *B65H 29/006* (2013.01); *B65H 2301/41912* (2013.01)

(58) Field of Classification Search

CPC ..... G07D 11/00; G07D 11/0021; G07F 7/04; G07F 9/02; B65H 7/02; B65H 7/04; B65H 2601/11

USPC ..... 194/200, 206, 207; 235/379; 209/534; 271/3.16, 3.21, 258.01, 259

See application file for complete search history.

(56) References Cited

U.S. PATENT DOCUMENTS

| | | | | |
|---|---|---|---|---|
| 7,677,546 | B2 * | 3/2010 | Saltsov et al. | 271/3.14 |
| 2003/0205618 | A1 | 11/2003 | Katou et al. | |
| 2007/0221469 | A1 * | 9/2007 | Katou et al. | 194/206 |
| 2011/0005892 | A1 | 1/2011 | Ohishi | |
| 2012/0255832 | A1 | 10/2012 | Kashiwabuchi | |

FOREIGN PATENT DOCUMENTS

| | | | |
|---|---|---|---|
| EP | 1 291 831 | A2 | 3/2003 |
| JP | 2011-018172 | A | 1/2011 |
| JP | 2011-134222 | A | 7/2011 |

* cited by examiner

*Primary Examiner* — Mark Beauchaine
(74) *Attorney, Agent, or Firm* — Rabin & Berdo, P.C.

(57) ABSTRACT

A temporary storage in a medium storing device carries out ON/OFF monitoring of a jam sensor between a winding start position of a drum and a clamp point of a delivering roller. Accordingly, when bills are rewound in the reset operation, even when a relationship between a pulse count and a bill position becomes different from actual one, it is possible to detect, without using a pulse count, a jam between the winding start position and the clamp point. It is possible to more securely detect the abnormality in bill storing in comparison with the prior art.

8 Claims, 24 Drawing Sheets

MEDIUM STORING DEVICE

TECHNICAL FIELD

The present invention relates to a medium storing device, for example, to an automatic cash transaction apparatus for dealing with bills as a medium.

BACKGROUND ART

Conventionally, as an automatic cash transaction apparatus for carrying out deposit/withdrawal of bills in response to operation of a customer, known is, for example, a recirculating type of automatic cash transaction apparatus for re-using deposited bills for withdrawal. The recirculating type of automatic cash transaction apparatus is disclosed, for example, in Japanese patent laid-open publication No. 2011-134222 in which, in depositing, when the user inserts a bill into the bill deposit/withdrawal port of a customer service section, the inserted bill is validated by a validator and subsequently the bill validated as a regular bill is stored in a temporary storage, whereas another bill not determined transactable is returned to the bill deposit/withdrawal port and repaid to the user.

The temporary storage is provided with a drum having a pulse motor to convey bills coming from the inlet/outlet port of the temporary storage to the drum by a delivering roller to store the bills while being wound around the drum. When bills are stored in the temporary storage, pulse counts at the time of starting rotation of the drum and the time that the top and rear ends of bills pass through a sensor arranged between the inlet/outlet port of the temporary storage and the drum, and further a pulse count at the time of stopping the rotation of the drum are stored in a memory. On the basis of those pulse counts, it is managed where the bills are wound in association with the rotation amount of the drum.

Now, in the above-described conventional automatic cash transaction apparatus, when any failure occurs to stop the automatic cash transaction apparatus, a manual rotation of the drum of the temporary storage with the bills wound around the drum would cause the actual positions of the bills wound around the drum to be rendered shifted from the pulse counts stored in the memory for restoring from the failure, thus causing the relationship of both to be inaccurate.

Meanwhile, in a reset operation to be carried out after restoration of the automatic cash transaction apparatus, it is checked how bills remain in the temporary storage. If a bill remains, the above-described rewinding operation is carried out to rewind the bill.

However, if the rewinding operation is carried out when the position of bills wound around the drum shifts from a pulse count stored in the memory as described above, the pulse count stored in the memory cannot be used to restart an accurate monitoring of passing bills by means of the sensor.

In practice, when the sensor carries out the monitoring of bills in such a situation, the difference between the pulse counts stored in the memory and the positions of the bills actually wound around the drum causes a possibility of erroneously recognizing that the bills are not normally rewound, i.e. an error in rewinding, even when the bills are actually normally rewound.

Therefore, it would have been possible that in the reset operation the monitoring of passing bills by the sensor is not carried out. However, when arranged accordingly, for instance, a bill, when jammed between the drum and delivering roller could not be detected, so that the drum would continue to rotate to stagnate the jammed bill to thereby cause the apparatus to malfunction.

Thus, the conventional temporary storage cannot securely detect abnormality, such as jam, under particular conditions, such as the reset operation.

SUMMARY OF THE INVENTION

It is an object of the present invention to provide a medium storing device that can more securely detect abnormality in comparison with a conventional device.

The medium storing device according to the present invention comprises a drum winding a medium and storing it around its circumference face, a delivering roller sending the medium coming from an inlet/outlet port for winding to send the medium to the drum, and rewinding the medium rewound from the drum to the inlet/outlet port for rewinding; and a monitor monitoring a conveying path for the medium between a winding start position of the drum and the delivering roller, the monitor monitoring the conveying path regardless of a rotation amount of the drum obtained in winding.

In accordance with the present invention, for example, When bills are rewound in the reset operation, an erroneous detection that would otherwise be caused by using a pulse count obtained in winding is removed, and it is thus possible to correctly detect a jam occurring between the drum and the delivering roller. Thus, a medium storing device can be implemented which is capable of securely detecting the abnormality in bill winding in comparison with the prior art.

The inventive concept disclosed in the application may also be defined in ways other than in the claims presented below. The inventive concept may consist of several separate inventions particularly if the invention is considered in light of explicit or implicit subtasks or from the point of view of advantages achieved. In such a case, some of the attributes included in the claims may be superfluous from the point of view of separate inventive concepts. Within the framework of the basic inventive concept, features of different embodiments are applicable in connection with alternative embodiments.

The application coverage of the present invention extends to an optional combination, or a partly extraction, of part or all of various embodiments described below.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
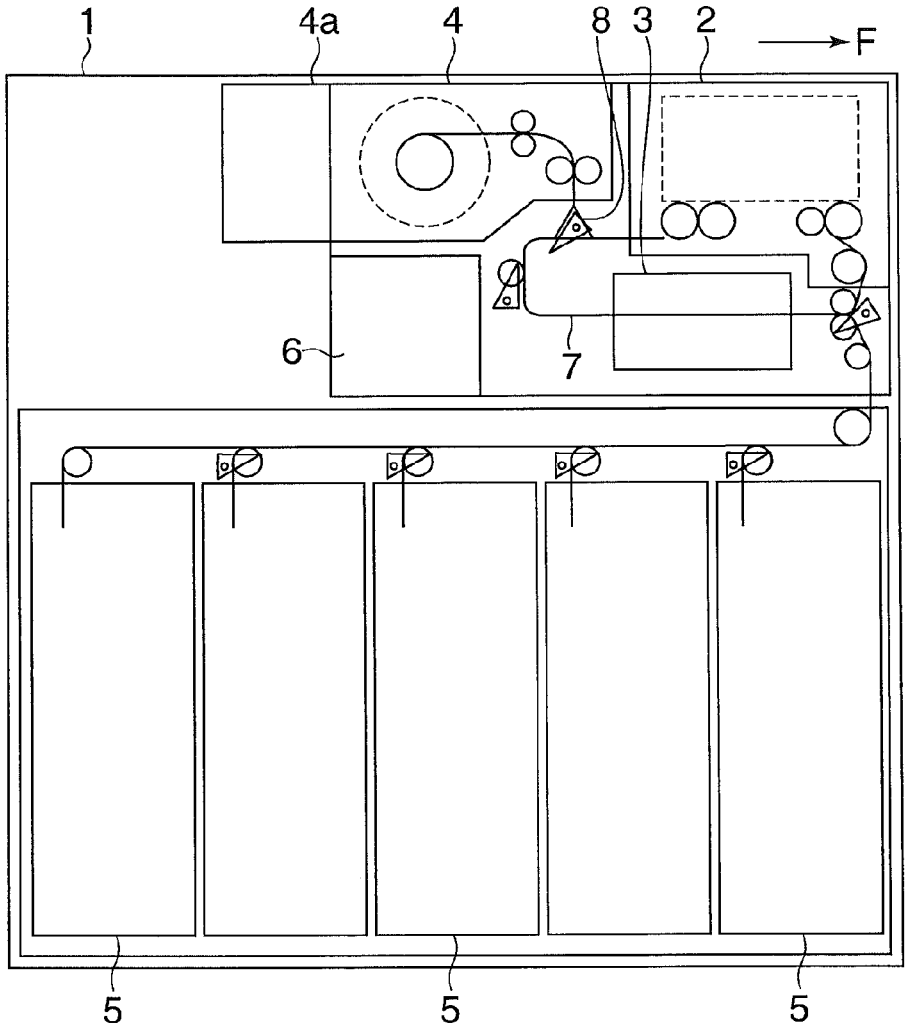
FIG. 1 is a perspective elevation view schematically showing an the internal structure of an automatic cash transaction apparatus in accordance with an embodiment of the present invention.

With reference to the accompanying drawings, Embodiments according to the present invention will be described in detail. First, referring to FIG. 1, a recirculating type of automatic cash transaction apparatus 1 in accordance with the embodiment of the present invention comprises subunits, such as a customer servicing section 2, a bill validator 3, a temporary storage 4, bill cassettes 5 and a reject cassette 6, arranged as illustrated, and further includes a conveying path 7 connecting those subunits to convey bills and a blade 8 for switching the subunits as a bill destination, those components being configured to be generally controlled by a main controller, not shown.

The customer servicing section 2 is an interface section arranged to face the user to receive and deliver bills from and to the user. The customer servicing section 2 is provided with a separating mechanism for separating bills inserted by the user for depositing one by one to send them to the conveying path 7 and a collecting mechanism for collecting bills send from the bill cassettes 5 for withdrawing. In the following description, of the apparatus housing 1, the user's side is referred to as a near or front side F, the rear or far side as a side B, the upward side as a side U and the downward side as a side D.

The bill validator 3 validates bills conveyed from the customer servicing section 2 for depositing, and also validates bills conveyed from the bill cassettes 5 for withdrawing, and then transmits a signal indicating an obtained validation result to the controller. The controller decides a bill destination on the basis of the validation result transmitted from the bill validator 3.

The temporary storage 4 is a bill stockroom adapted to temporarily store bills validated as normal bills by the bill validator 3 for depositing, and to separate, when the user confirms the depositing amount on the customer servicing section 2, the bills one by one to send them to the conveying path 7. The normal bills sent from the temporary storage 4 to the conveying path 7 in this way are validated for denomination by the bill validator 3 and stored in the bill cassettes 5, described below, according to the denominations.

The temporary storage 4 is also configured to temporarily store bills validated as abnormal bills by the bill validator 3 for withdrawing, and to send, when the user confirms the withdrawing amount on the customer servicing section 2, the bills to the conveying path 7. The abnormal bills sent from the temporary storage 4 to the bill conveying path 7 in this way are stored in the reject cassette 6. The temporary storage 4 further comprises a unit controller 4*a* for controlling the operation of the temporary storage 4.

The bill cassettes 5 are bill stockrooms adapted to store bills replenished for withdrawing and bills deposited for depositing transaction. The bill cassettes 5 are provided with a separating mechanism and a collecting mechanism, like the customer servicing section 2.

The reject cassette 6 is a bill stockroom adapted to store bills validated as abnormal bills by the bill validator 3, and provided with a collecting mechanism, too.

The blade 8 is an elongated member having a wedge-like cross section and capable of turning by a rotary drive mechanism, not shown, by a predetermined angle in response to a command signal from the controller, thereby switching the bill destination.

Figure 2:
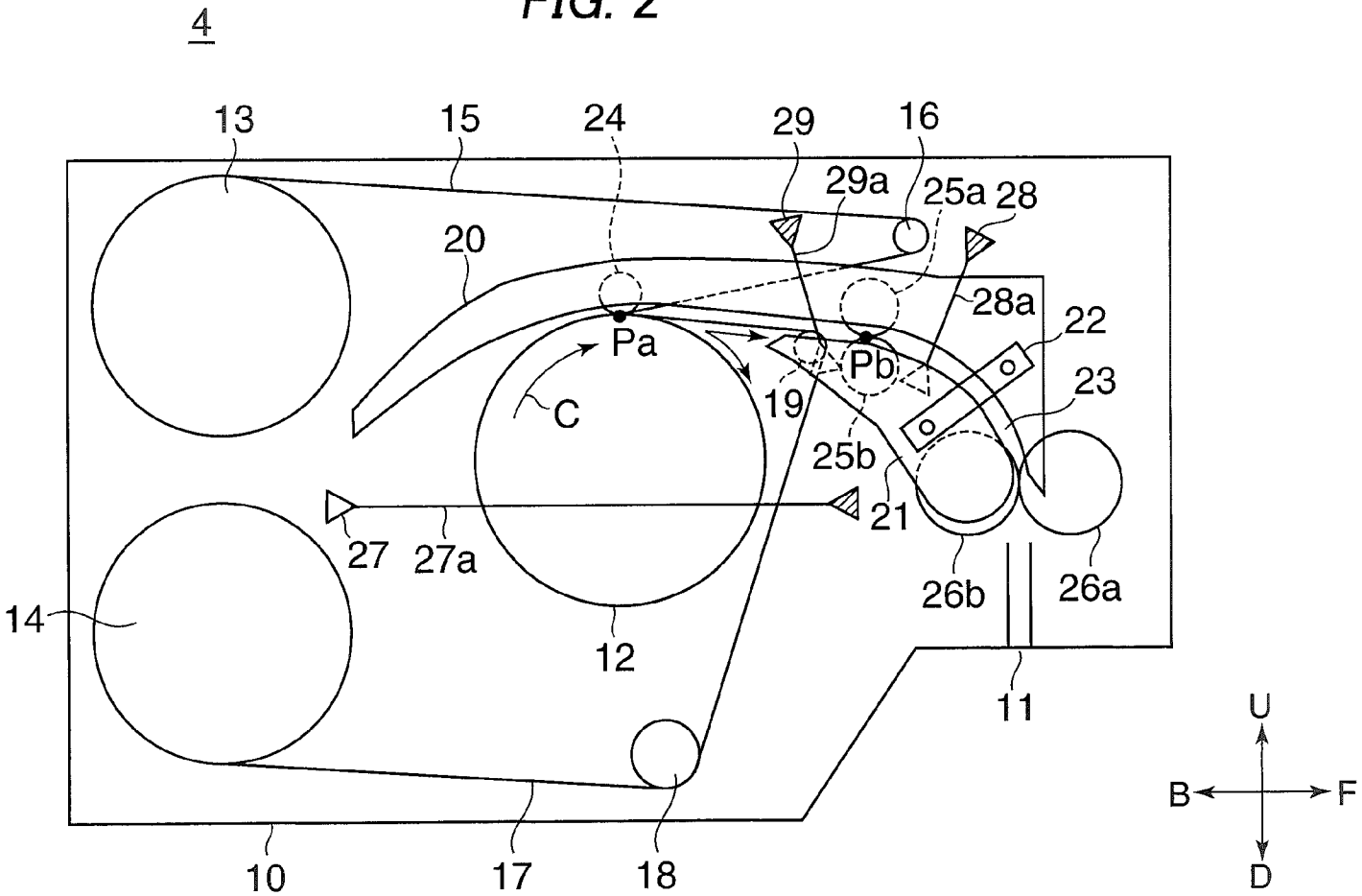
FIG. 2 is a perspective elevation view schematically showing an example of the internal structure of a temporary storage.

Next, an exemplified structure of the temporary storage 4 of the automatic cash transaction apparatus 1 will be described with reference to FIGS. 2 to 10. FIG. 2 shows the structure of the components other than the unit controller 4*a* of the temporary storage 4. As shown in FIG. 2, the temporary storage 4 has a bill inlet/outlet port 11 opening on the lower front (B) side (lower right in the figure) of a housing 10 and configured so that bills can be inserted into and ejected from the bill inlet/outlet port 11.

At the center of the temporary storage 4, disposed is a cylindrical drum 12 extending in the lateral direction (L, R shown in FIG. 10, for instance) with respect to the apparatus housing 1, i.e. the direction perpendicular to the paper sheet of FIG. 2. On the upper backward (B) side (upper left in the figure) of the drum 12, an upper reel 13 is arranged, and on the lower backward side (lower left in the figure) of the drum 12, a lower reel 14 is arranged. The drum 12, upper reel 13 and lower reel 14 are mechanically connected with a winding motor via a driving system, not shown either, and configured to be rotatable.

An upper tape 15 is pulled forward to an upper roller 16 arranged on the diagonally upper forward (F) side of the drum 12 so as to run above the drum 12 from the upper reel 13 and turned backward to the top part of the circumference of the drum 12 by the upper roller 16.

On the other hand, a lower tape 17 is pulled forward (F) from the lower reel 14 to a first lower roller 18 arranged below the drum 12 and turned upward to a second lower roller 19 arranged in front of the drum 12 by the first lower roller 18 so as to run in front of the drum 12, and further turned backward to the top part of the circumference of the drum 12 by the second lower roller 19.

Due to the configuration, the temporary storage 4 rotates the drum 12, upper reel 13 and lower reel 14, thereby winding the upper tape 15 pulled from the upper reel 13 and the lower tape 17 pulled from the lower reel 14 around the drum 12 with the top part of the circumference of the drum 12 set as a winding start position Pa while layering the upper tape 15 on the lower tape 17.

The temporary storage 4 further comprises an upper movable guide 20 arranged to cover the bill inlet/outlet port 11 through the backward side (B) of the circumference face of the drum 12 from above, and. below the front side (F) of the upper movable guide 20, a lower movable guide 21 arranged to extend from a vicinity of the bill inlet/outlet port 11 to the second lower roller 19 near the drum 12 along the lower face of the upper movable guide 20.

The upper movable guide 20 and lower movable guide 21 are connected with each other by a movable guide bracket 22 with a predetermined distance formed therebetween. The distance forms a conveying path 23 between the bill inlet/outlet port 11 and the drum 12.

In the upper movable guide 20, a winding roller 24 is also arranged at a position just above the drum 12. The winding roller 24 is configured to come into contact from above with the top part of the circumference of the drum 12, i.e. the winding start position Pa.

In the temporary storage 4, closer to the bill inlet/outlet port 11 than the lower second roller 20 on the front side (F) of the drum 12, a pair of delivering rollers 25*a* and 25*b* are disposed across the conveying path 23 to face each other. In addition, closer to the bill inlet/outlet port 11 than delivering rollers 25*a* and 25*b*, a pair of conveying rollers 26*a* and 26*b* are disposed across the conveying path 23 to face each other. Among those rollers, the delivering roller 25*a* is held by the upper movable guide 20, and the delivering roller 25*b* and conveying roller 26*b* are held by the lower movable guide 21. The delivering rollers 25*a* and 25*b* and conveying rollers 26*a* and 26*b* are rotatably connected with a delivering motor via another driving system, not shown either, separate from the above-described driving system.

Thus, the temporary storage 4 rotates the delivering rollers 25*a* and 25*b* and conveying rollers 26*a* and 26*b*, and conducts bills between the delivering rollers 25*a* and 25*b* and between the conveying rollers 26*a* and 26*b*, thereby conveying the bills in the direction from the bill inlet/outlet port 11 on the conveying path 23 to the drum 12 or the direction opposite thereto.

For instance, when a bill is stored in the temporary storage 4, the drum 12 is rotated counterclockwise in FIG. 2 while rotating the delivering rollers 25*a* and 25*b* and conveying rollers 26*a* and 26*b* to thereby convey the bill from the bill inlet/outlet port 11 to the drum 12 to send the same toward between the upper tape 15 and lower tape 17. Then, the bill is supported between the upper tape 15 and lower tape 17 and wound while being abutted against the drum 12. Thus, the bill is stored on the circumference of the drum 12.

By contrast, when a bill is withdrawn from the temporary storage 4, the drum 12 is rotated clockwise C in the figure to wind the upper tape 15 and lower tape 17 respectively around the upper reel 13 and lower reel 14 to send the bill to the conveying path 23. At this moment, in the temporary storage 4, the delivering rollers 25*a* and 25*b* and conveying rollers 26*a* and 26*b* are rotated in the direction opposite to the direction for storing, thereby conveying the bill to the bill inlet/outlet port 11.

In this way, the temporary storage 4 can wind and store bills, and rewind and withdraw, i.e. discharge, stored bills.

Figure 3:
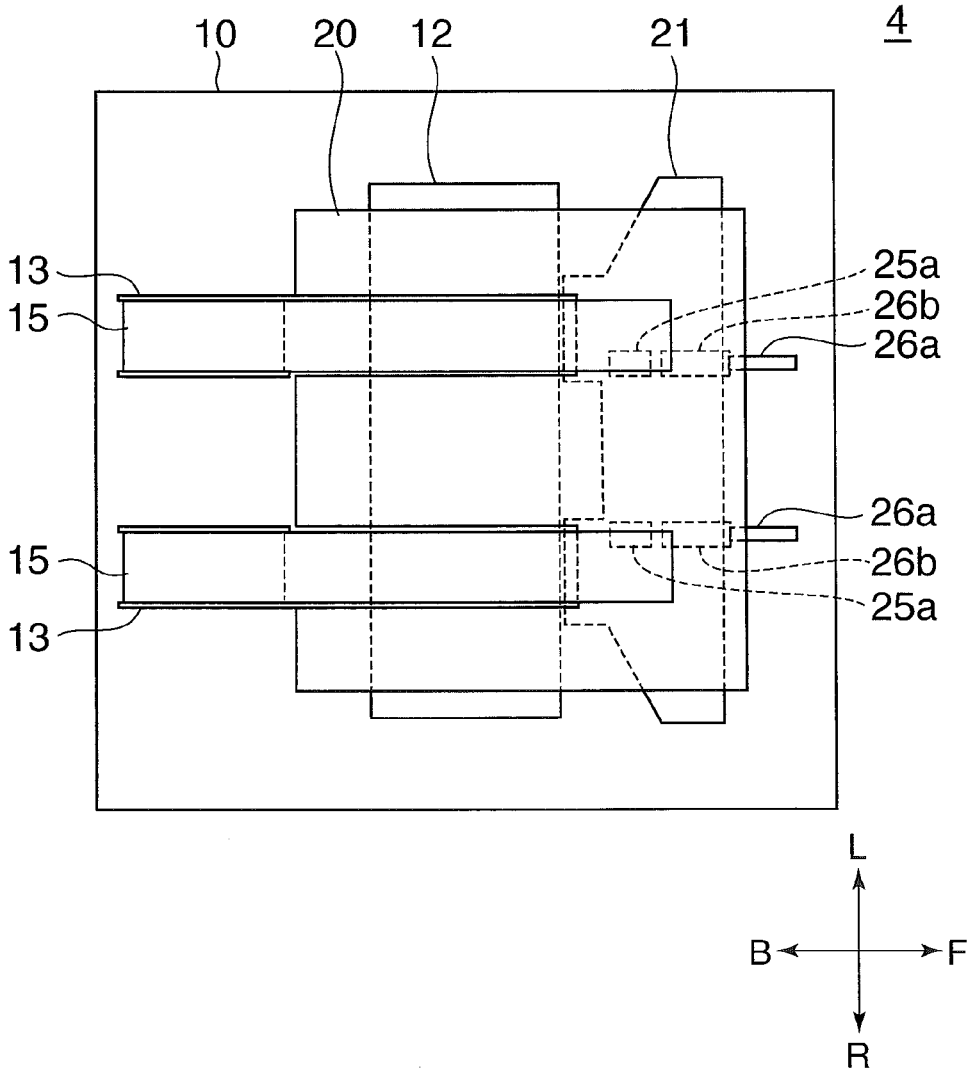
FIG. 3 is a schematic plan view showing the internal structure of the temporary storage shown in FIG. 2 as viewed from above.
Figure 4A:
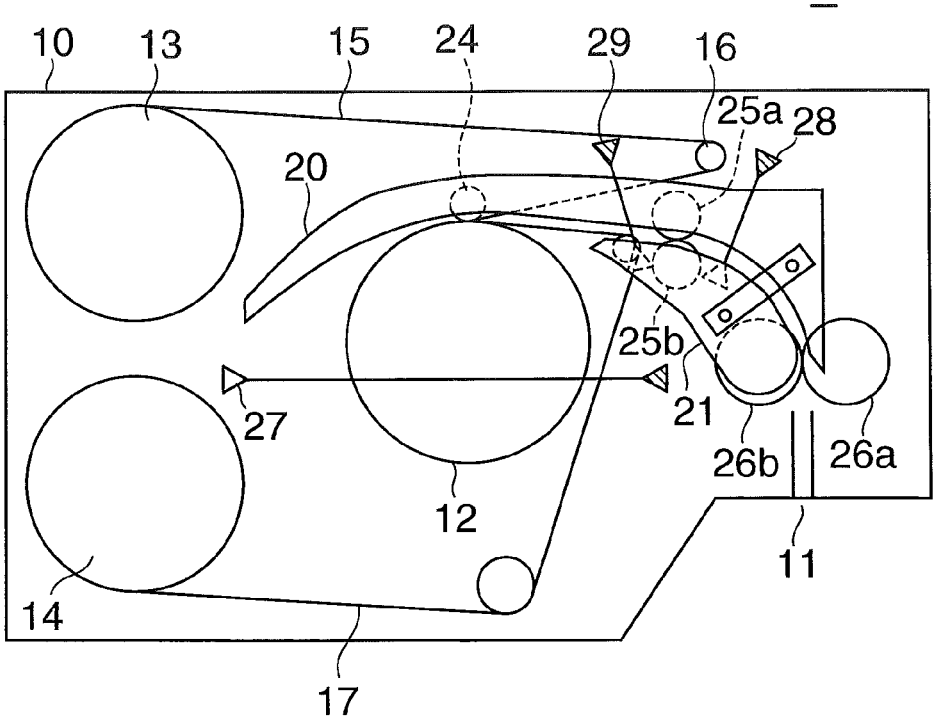
FIGS. 4A and 4B are perspective elevation views, like FIG. 2, for use in describing movement of a movable guide in the temporary storage shown in FIG. 2.
Figure 4B:
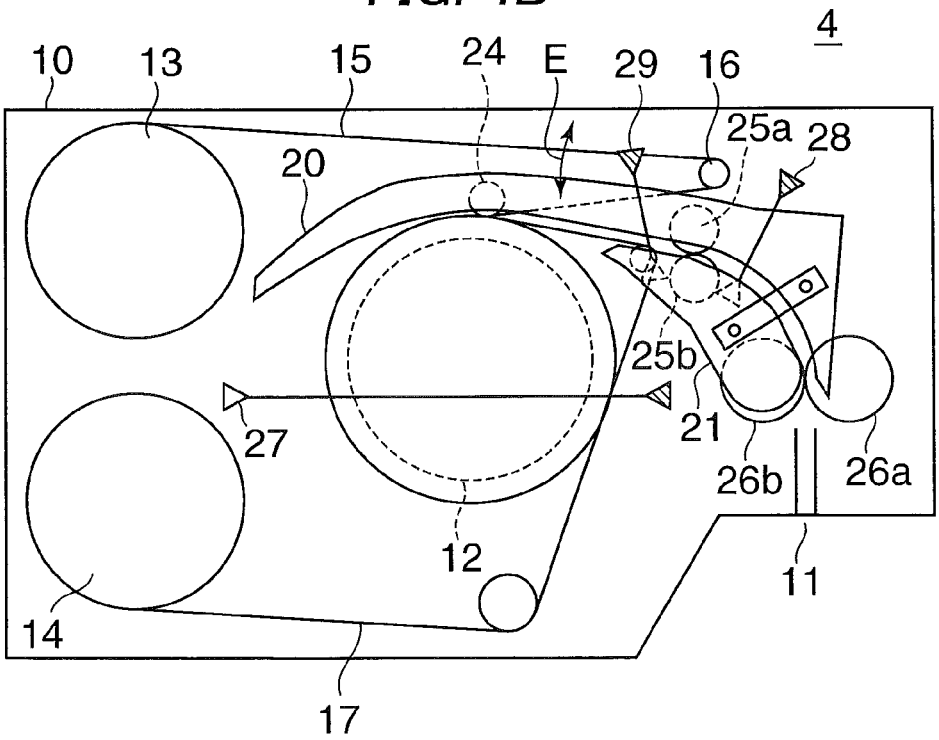

Note that, although FIG. 2 illustrates the upper reel 13, lower reel 14, upper tape 15, upper roller 16, lower tape 17, first lower roller 18 and second lower roller 19 seen from the near side on the paper sheet of the figure, in practice on the far side on the paper sheet there are also arranged the correspondent components paired with the former components. This situation also can be understood from FIG. 10. In other words, the temporary storage 4 comprises a couple of upper reels 13, a couple of lower reels 14, a couple of upper tapes 15, a couple of upper rollers 16, a couple of lower tapes 17, a couple of first lower rollers 18 and a couple of second lower rollers 19 arranged respectively on the near and far sides in the figure, i.e. on the left and right sides (L, R) viewing from the front side (F). Therefore, the temporary storage 4 can hold a bill at the left side (L) of between the left upper tape 15 and left lower tape 17 and at the right side (R) between the right upper tape 15 and right lower tape 17 to wind the same around the drum 12. Similarly, as seen in FIG. 3, there are also arranged a couple of delivering rollers 25*a* and 25*b* and a couple of conveying rollers 26*a* and 26*b* respectively on the right and left sides so as to be rotated to thereby receive bills therebetween to convey the bills.

Well, the entire diameter of the drum 12 including bills and the layers of tape wound there around varies in accordance with not only the layers of the tape wound around the drum 12 but also the number of the bills wound around the drum 12. Therefore, the temporary storage 4 is configured so that the upper movable guide 20 and lower movable guide 21 follows the variation to turn about a pivotal point substantially coaxial to the rotation axis of the conveying roller 26*b* as indicated by arrow E in FIG. 4B. Accordingly, the winding roller 24 can always come into contact with the top part of the wound tape on the circumference of the drum 12, i.e. the winding start position Pa.

Moreover, the temporary storage 4 is configured so as to allow, for maintenance servicing, the drum 12, upper reel 13, lower reel 14, delivering rollers 25*a* and 25*b* and conveying rollers 26*a* and 26*b* to manually rotate with a knob not shown.

In addition, the temporary storage 4 is provided with, as shown in FIG. 2, a residual sensor 27 detecting whether or not there is a bill wound around the drum 12. The residual sensor 27 may be, for instance, a photoelectric sensor having a combination of a light emitting device and a photosensitive device. The light emitting device may be, for instance, a light emitting diode (LED) adapted to emit a light beam 27*a*, and the photosensitive device may be, for instance, a photo diode arranged so that the optical axis 27*a* is substantially perpendicular to the rotation axis of the drum 12 to receive the light beam 27*a*.

Furthermore, the temporary storage 4 is provided with a delivering sensor 28 detecting whether or not there is a bill passing between the delivering rollers 25*a*, 25*b* and conveying rollers 26*a*, 26*b*. The delivering sensor 28 also may be, for instance, a photoelectric sensor having a combination of a light emitting device and a photosensitive device, and is arranged so that an optical axis 28*a* traverses the conveying path between delivering rollers 25*a*, 25*b* and conveying rollers 26*a*, 26*b*. In the embodiment, the delivering sensor 28 is configured to be conductive "ON" when the optical axis 28*a* is intercepted by a bill running on the conveying path 23 and to non-conductive "OFF" when the optical axis 28*a* is not intercepted.

The temporary storage 4 is configured to store a count of pulses, i.e. pulse count, obtained from the winding motor which is a pulse motor in the embodiment into a memory, not shown, of the unit controller 4*a*, FIG. 1. The unit controller 4*a* can indirectly determine, on the basis of the pulse count, at which position on the drum 12 bills are wound around. A specific way of detecting the positions will be described in detail with reference to FIGS. 5A to 6C.

For instance, when two bills are continually wound around the drum 12, the controller 4*a* recognizes, for example, by means of a notification signal from outside the storage 4, that a first bill BL1 directed to the temporary storage 4 is conveyed to a predetermined position near the temporary storage 4 to start the rotation of the winding motor, the drum 12 thereby starting rotating in the direction indicated by an arrow CC. Simultaneously, the pulse count Cs, e.g. "0", at this time is stored in the memory.

Figure 5A:
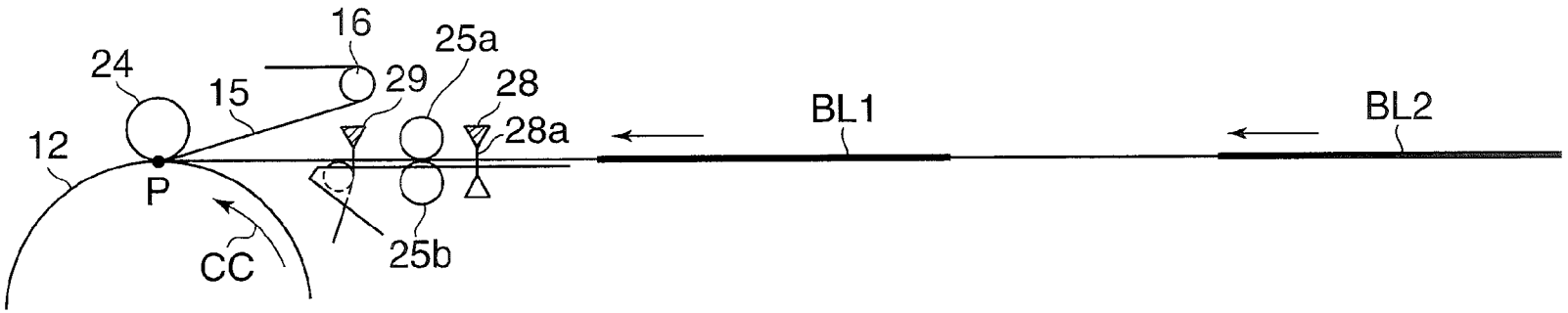
FIGS. 5A to 5C are schematic diagrams for use in describing the winding operation of bills by the temporary storage.
Figure 5B:
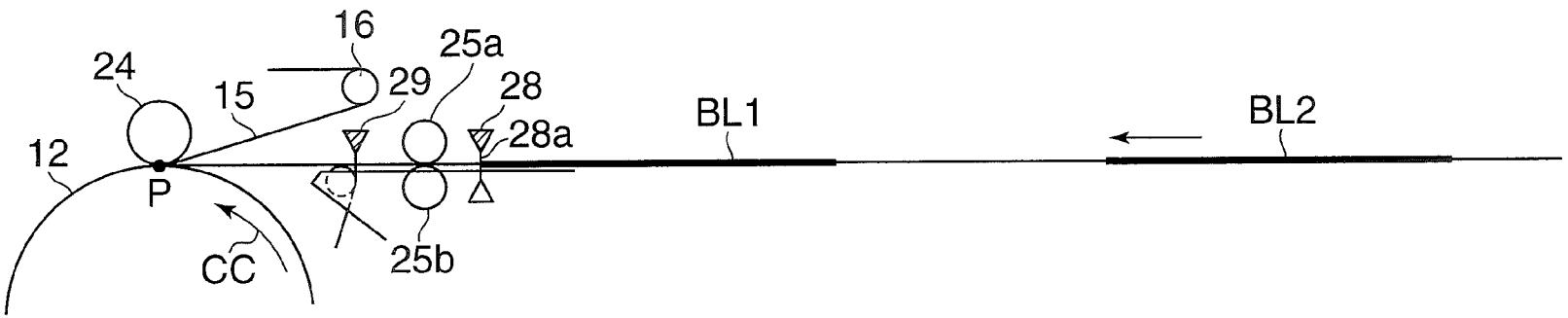

Thence, the controller 4*a* monitors when the delivering sensor 28 is conductive. This is called as an ON monitoring. As shown in FIG. 5B, when the delivering sensor 28 is rendered conductive in response to the top end of the bill BL1 arriving at the optical axis 28*a* of the delivering sensor 28, the pulse count C1s predominant at this time is stored in the memory.

Figure 5C:
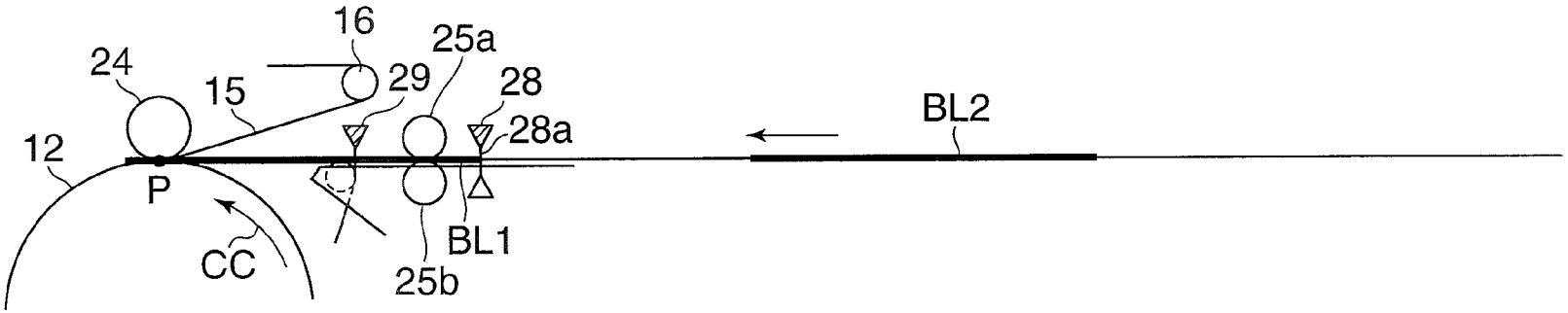

Next, the controller 4*a* monitors when the delivering sensor 28 is non-conductive. This is called as an OFF monitoring. As shown in FIG. 5C, when the delivering sensor 28 becomes non-conductive in response to the rear end of the bill BL1 departing from the optical axis 28*a* of the delivering sensor 28, the pulse count C1e predominant at this time is stored in the memory.

Figure 6A:
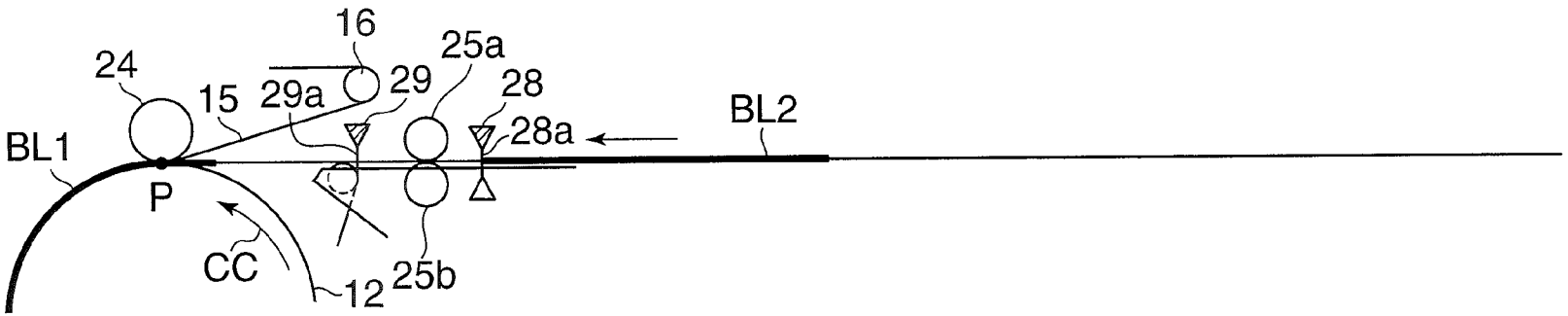
FIGS. 6A to 6C are schematic diagrams for use in describing the operation winding of bills by the temporary storage.

The controller 4*a* carries out again the ON monitoring of the delivering sensor 28. As shown in FIG. 6A, when the delivering sensor 28 is rendered conductive in response to the top end of a bill BL2 arriving at the optical axis 28*a* of the delivering sensor 28, the pulse count C2s predominant at this time is stored in the memory.

Figure 6B:
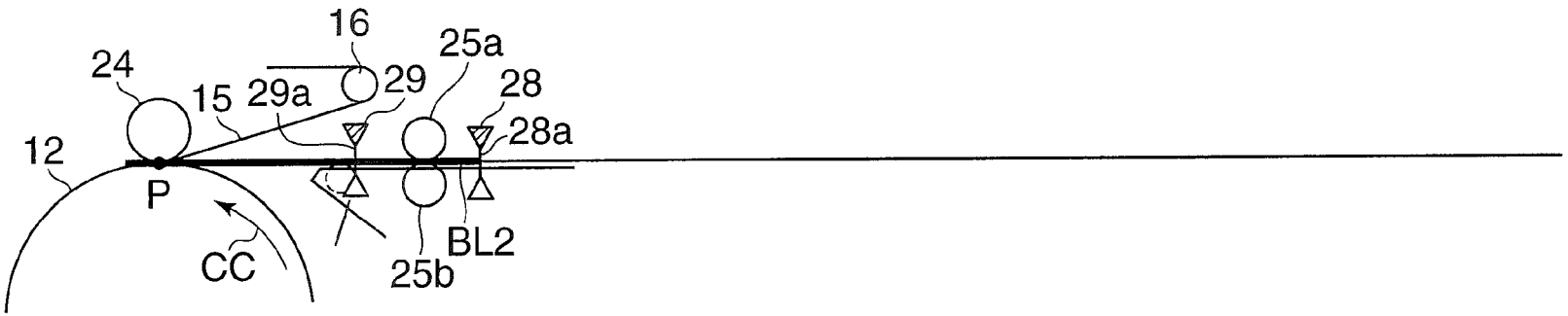
Figure 6C:
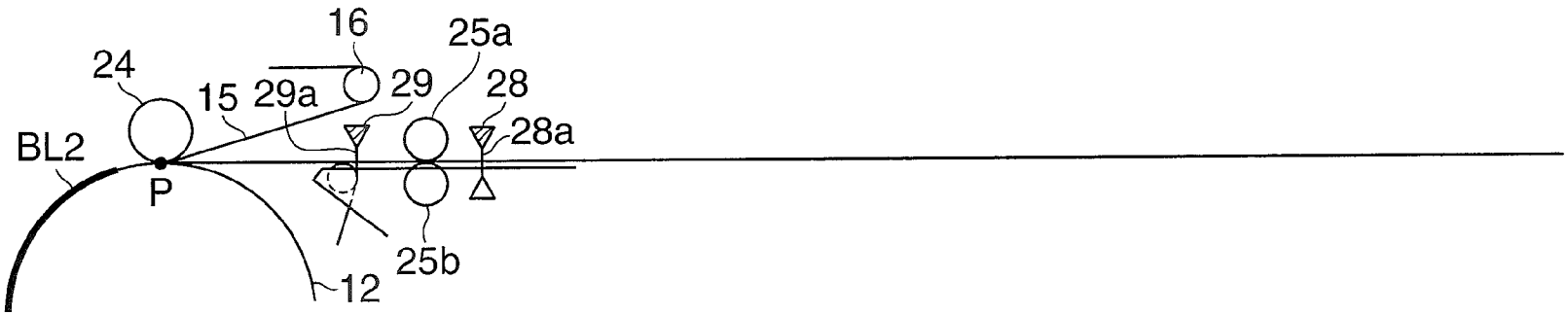

Next, the controller 4*a* carries out the OFF monitoring of the delivering sensor 28. As shown in FIG. 6B, when the delivering sensor 28 becomes non-conductive in response to the rear end of the bill BL2 departing from the optical axis 28*a* of the delivering sensor 28, the pulse count C2e predominant at this time is stored in the memory.

After that, the controller 4*a* stops, as shown in FIG. 60, the rotation of the winding motor at the time that the bill BL2 is wound around the drum 12, thereby stopping the rotation of the drum 12. At this moment, the pulse count Ce currently predominant is stored in the memory.

Thus, the controller 4*a* stores the respective pulse counts Cs and Ce at the start and stop times of the rotation of the winding motor, the respective pulse counts C1s and C2s at the arrival times of the top ends of the bills BL1 and BL2 at the optical axis 28*a* of the delivering sensor 28, and the respective pulse counts C1e and C2e at the times at which the rear ends of the bills BL1 and BL2 leaving the optical axis 28*a* of the delivering sensor 28.

The controller 4*a* is configured to store the pulse counts at the timing described above. Therefore, on the basis of those pulse counts, the controller 4*a* manages the rotation amount of the drum 12 assigned to the position of bills wound around the drum 12. Thus, the controller 4*a* can indirectly determine, by means of the pulse count, at which position on the drum 12 bills are wound around.

In summary, the temporary storage 4 carries out the ON/OFF monitoring of the delivering sensor 28 for winding and, at the timing when the sensor 28 becomes conductive/non-conductive, assigns the rotation amount of the drum 12 to the wound position of a bill on the basis of the pulse count stored in the memory to manage them. Accordingly, it is possible to indirectly determine at which position on the drum 12 bills are wound around.

The unit controller 4*a* may be implemented by, for instance, a processing system, such as a microcomputer. The function of the controller 4*a* can at least partially or entirely be implemented by a computer in which program sequences are installed and run. This is also the case with the above-described main controller.

Now, in the temporary storage 4 of the embodiment, it is possible, when rewinding bills, to detect, without using a pulse count, a jam occurring between the winding start position PA of the drum 12 and a clamp point PB of the delivering rollers 25*a* and 25*b* by a jam sensor 29. For this purpose, the jam sensor 29 is arranged in the embodiment so as to detect a jam occurring between the winding start position Pa of the drum 12 and a close point of the delivering rollers 25*a* and 25*b*, i.e. the clamp point Pb. The jam sensor 29 also may be a photoelectric sensor configured by a combination of a light emitting device and a photosensitive device. The jam sensor 29 is also configured to be conductive "ON" when the optical axis 29*a* is intercepted by a bill, and non-conductive "OFF" when the optical axis 29*a* is not intercepted.

In more detail, the jam sensor 29 is arranged so that the optical path 29*a* passes between the upper face of the rear end of the lower movable guide 21 and the lower face of the upper movable guide 20 above the former. Specifically, for instance, one of the light emitting device and photosensitive device are disposed in the rear end of the lower movable guide 21 and the other is disposed on the side of the upper movable guide 20 above the one device.

The jam sensor 29 is thus arranged at the position described above firstly because the rear end of the lower movable guide 21 forms a branching section of bills wound around the drum 12 and bills to be sent to the conveying path 23, so that a jam is likely to occur there when rewinding bills.

Secondly, if the optical axis 29*a* of the jam sensor 29 were too close to the winding start position Pa of the drum 12, the possibility of erroneously detecting a wound bill as a jam would be increased.

Thirdly, by contrast, if the optical axis 29*a* of the jam sensor 29 were too close to the clamp point Pb of the delivering rollers 25*a* and 25*b*, the top end of a bill jamming between the winding start position Pa of the drum 12 and the clamp point Pb of the delivering rollers 25*a* and 25*b* would not reach the optical axis 29*a*, the possibility of failing to detect the jam being increased.

For those reasons, in the embodiment, one device of the jam sensor 29 is arranged in the rear end of the lower movable guide 21 and the other device is arranged on the side of the upper movable guide 20 above the one device.

Incidentally, a problem that would occur if a rewinding operation were carried out by utilizing a pulse count and the ON monitoring of the delivering sensor 28 without using the jam sensor 29 will be described FIGS. 7A to 8A in detail.

Figure 7A:
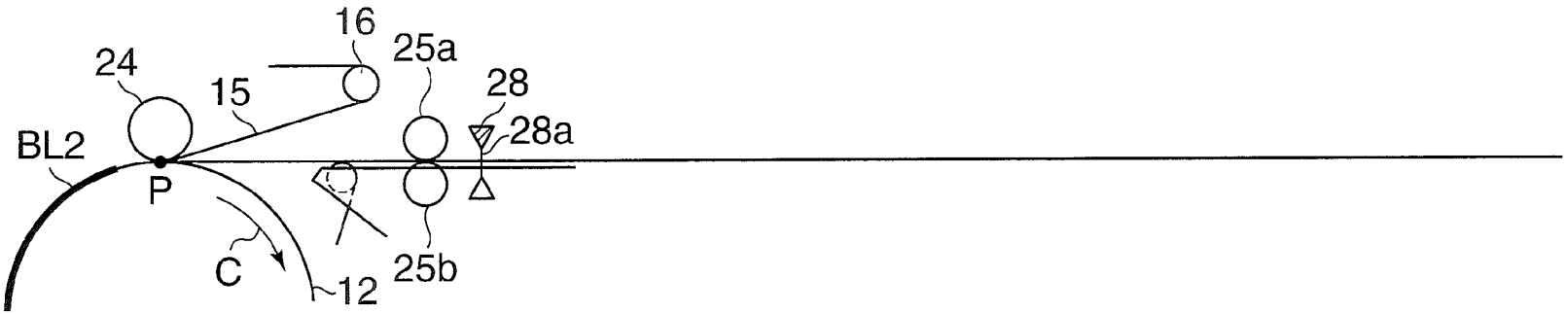
FIGS. 7A to 7C are schematic diagrams for use in describing the rewinding operation of bills by the temporary storage without a jam sensor.

When two wound bills BL1 and BL2 are rewound from the drum 12 in the direction of an arrow C, the controller 4*a* uses the number of the pulses which is a difference between the pulse count Ce when stopping the rotation of the winding motor and the pulse count C2e when the rear end of second bill BL2 leaves the optical axis 28*a* of the delivering sensor 28 as well as the rotation rate of the winding motor to calculate a time from the start of the rotation of the winding motor as shown in FIG. 7A to the arrival of the top end (rear end for winding) of the bill BL2 at the delivering sensor 28, i.e. an expected arrival time. That is, the controller 4*a* calculates, as an expected arrival time, the time from the rewinding start of the bill BL2 wound around the drum 12 to the arrival of the top end at the delivering sensor 28.

Figure 7B:
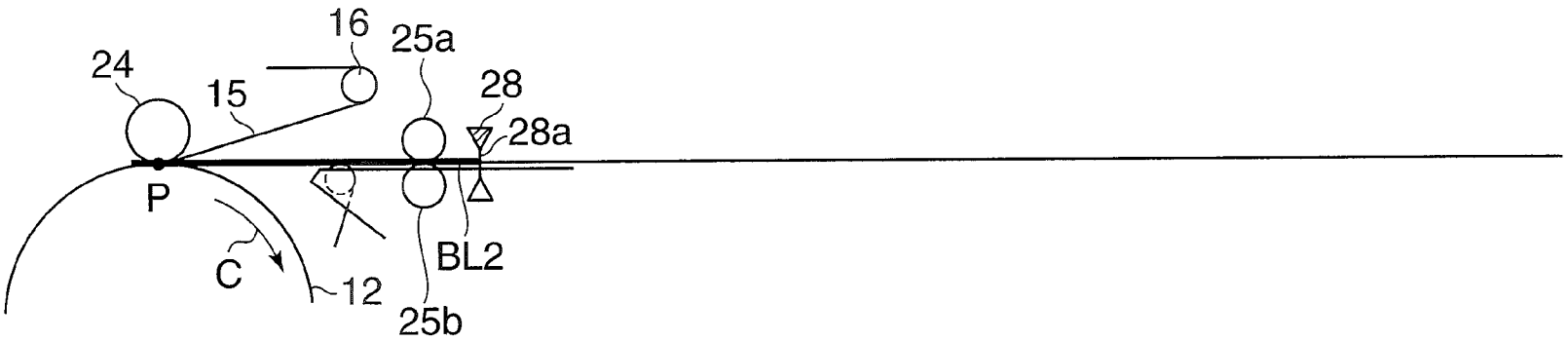
Figure 7C:
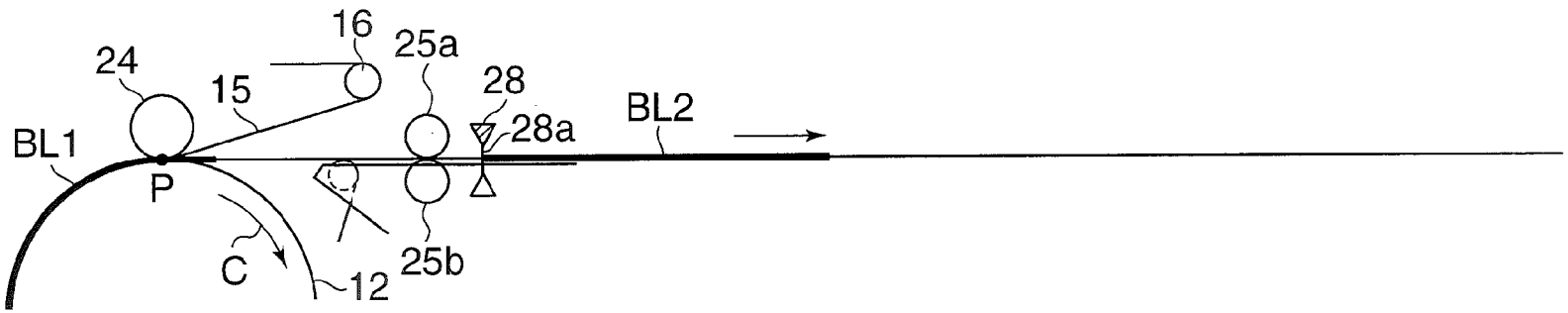

Then, the controller 4*a* starts rotating the winding motor and starts measuring the time. Subsequently, the controller 4*a* carries out the ON monitoring of the delivering sensor 28 for a predetermined time covering the expected arrival time. Note that, if the bill BL2 is normally rewound, as shown in FIG. 7B, the delivering sensor 28 will be rendered conductive within the predetermined time covering the expected arrival time.

Therefore, the controller 4*a* can determine that the bill BL2 is normally rewound if the delivering sensor 28 is rendered conductive for the predetermined time including the expected arrival time. By contrast, if the delivering sensor 28 is not rendered conductive within the predetermined time including the expected arrival time, the controller 4*a* determines that the bill BL2 is not normally rewound, and in turn stops the rotation of the winding roller to output an error signal.

Figure 8A:
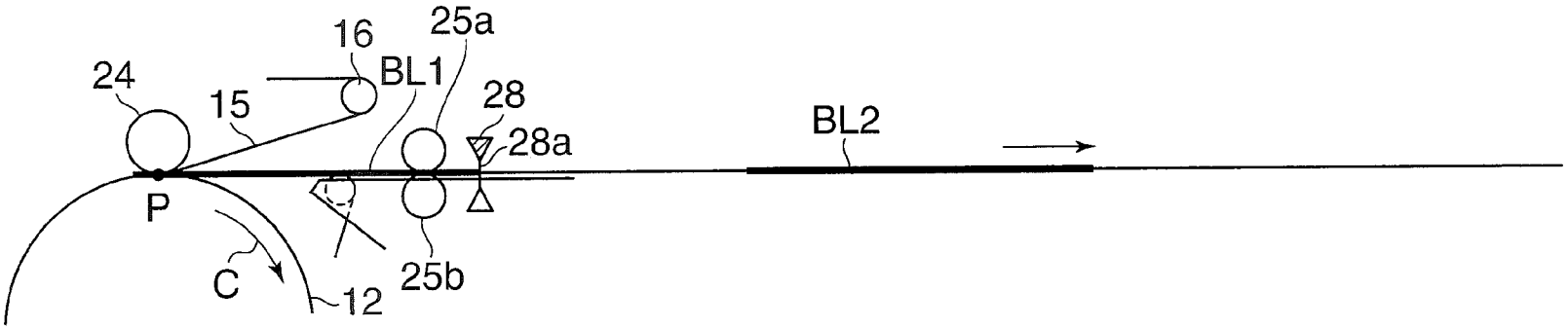
FIGS. 8A to 8C are schematic diagrams for use in describing the rewinding operation of bills by the temporary storage without a jam sensor.

The controller 4*a* uses the number of the pulses which is a difference between the pulse count C2s when the top of the bill BL2 arrives at the optical axis 29*a* and the pulse count C1e when the rear end of the bill BL1 leaves the optical axis as well as the rotation rate of the winding motor to calculate an expected arrival time from the departure of the rear top end of the bill BL2 from the optical axis 28*a* of the delivering sensor 28 rewound as shown in FIG. 70 to the arrival of the top end of the following bill BL1 at the delivering sensor 28 as shown in FIG. 8A.

Figure 8B:
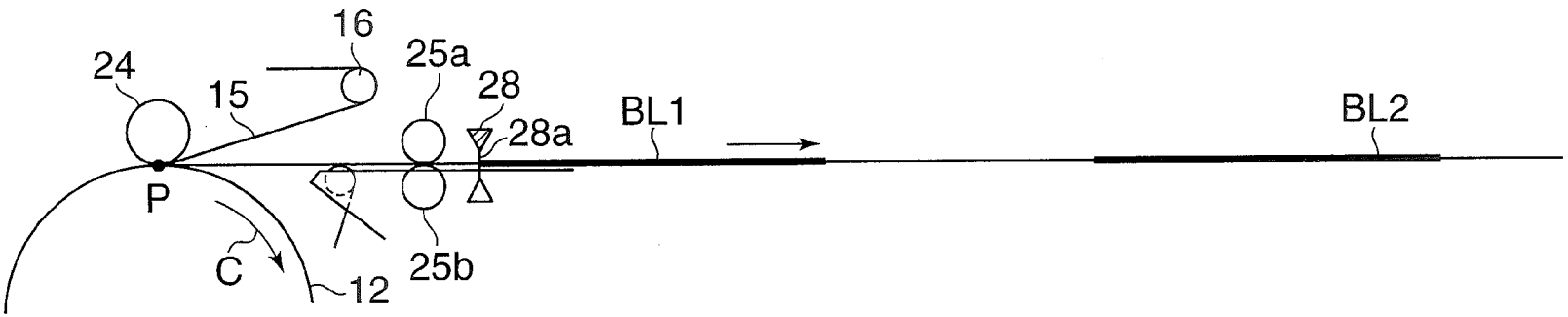
Figure 8C:
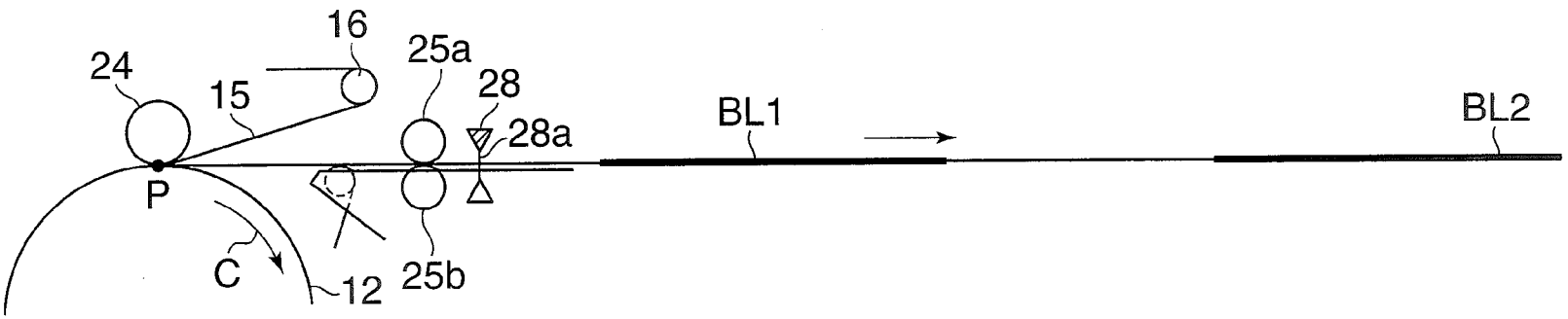

Next, the controller 4*a* carries out the ON monitoring of the delivering sensor 28 for the predetermined time covering this expected arrival time after the departure of the rear end of the bill BL2 from the optical axis 28*a* of the delivering sensor 28. Here, if the bill BL1 is normally rewound as shown in FIG. 8A, the delivering sensor 28 will be rendered conductive within the predetermined time covering the expected arrival time. Therefore, the controller 4*a* can determine that the bill BL1 is normally rewound if the delivering sensor 28 is rendered conductive within the predetermined time covering the expected arrival time. After that, the controller 4*a* stops the rotation of the winding motor when finishing normally rewinding the bill BL1 as shown in FIGS. 8B and 8C.

By contrast, if the delivering sensor 28 is not made conductive within the predetermined time including the expected arrival time, the controller 4*a* determines that the bill BL1 is not normally rewound, and in turn stops the rotation of the winding roller to output an error signal. Thus, the controller 4*a* of the temporary storage 4 can control the rewinding operation of the bill.

Incidentally, when some malfunction occurs on the automatic transaction apparatus 1 so that the apparatus 1 is stopped, as a recovery work, the drum 12 is often manually rotated by rotating the knob with bills wound around the drum 12 of the temporary storage 4. If such an operation were done, a difference would be caused between a pulse count stored in the memory for winding and the position of bills wound around the drum 12 to cause the relationship therebetween to be disturbed. Under that circumstance, if a reset operation is attempted on the automatic transaction apparatus 1 to rewind the bills, the difference between the pulse count and the bill positions would never cause the pulse count to be used for securely carrying out the ON monitoring of the delivering sensor 28, thus failing to securely detect whether or not the bills are normally rewound.

In order to prevent such a situation, the temporary storage 4 of the embodiment is configured so that the ON monitoring of the delivering sensor 28 is not carried out during the reset operation. However, if only the ON monitoring were temporarily made inoperative, an occurrence of a jam between the drum 12 and delivering rollers 25*a* and 25*b* could not be detected.

Thence, the temporary storage 4 of the embodiment is configured so that the jam sensor 29 is adapted at the above-described position, and further that the jam sensor 29 acts, during the reset operation, separately from the pulse count. That makes it possible to surely detect a jam occurring between the winding start position Pa of the drum 12 and the clamp point Pb of the delivering rollers 25*a* and 25*b*.

Figure 9A:
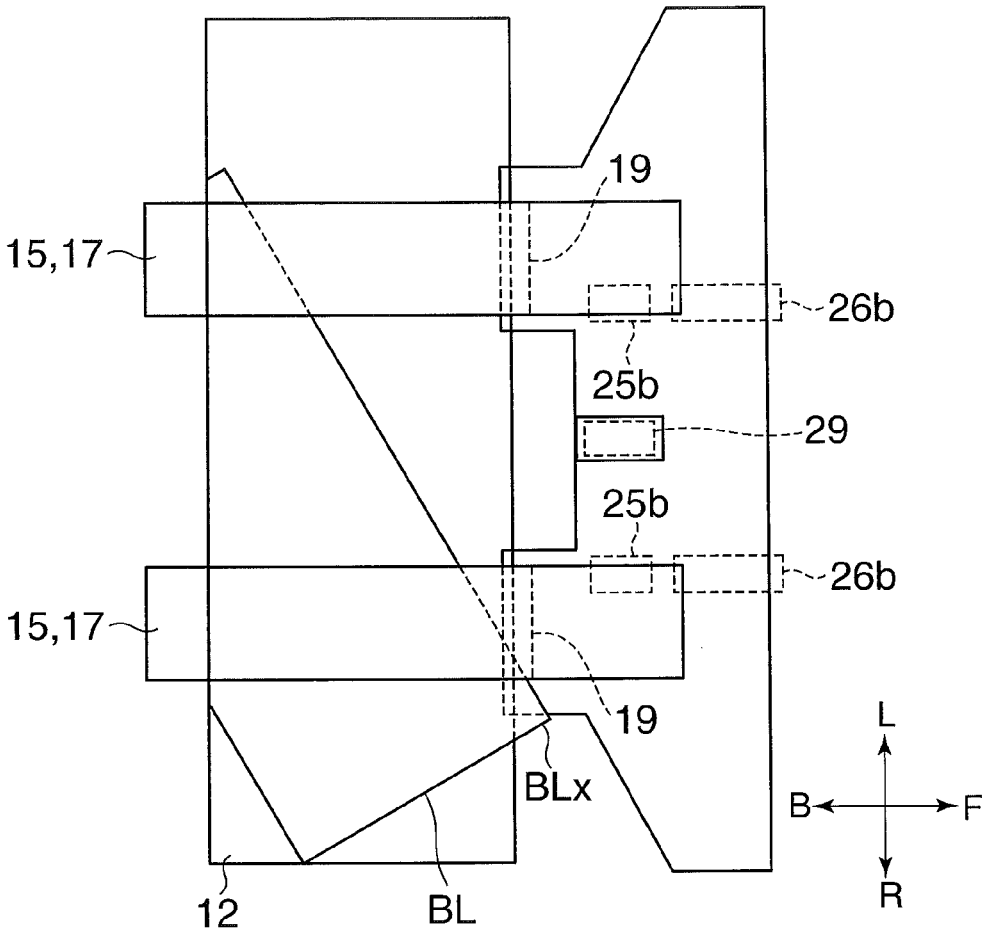
FIGS. 9A and 9B are respectively a plan view and a side view schematically showing the internal structure of the temporary storage to show how a corner of a bill is floated from the drum.
Figure 9B:
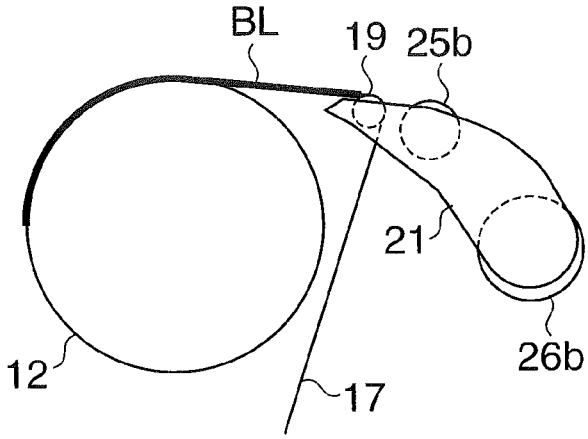

By the way, if the wound bill BL is skewed as shown in FIG. 9A, the bill BL has its corner BLx floated from the circumference face of the drum 12 outside (at the near side of) the upper tape 15 and lower tape 17 at the near side, or outside (at the far side of) the upper tape 15 and lower tape 17 at the far side, so that the corner BLx may pass the end of the top face of the rear end of the lower movable guide 21. That situation is not abnormal.

Therefore, in order not to erroneously detect this situation as a jam, the jam sensor 29 is disposed in the middle between the upper tape 15 and lower tape 17 at the near side and the upper tape 15 and lower tape 17 at the far side.

Figure 10:
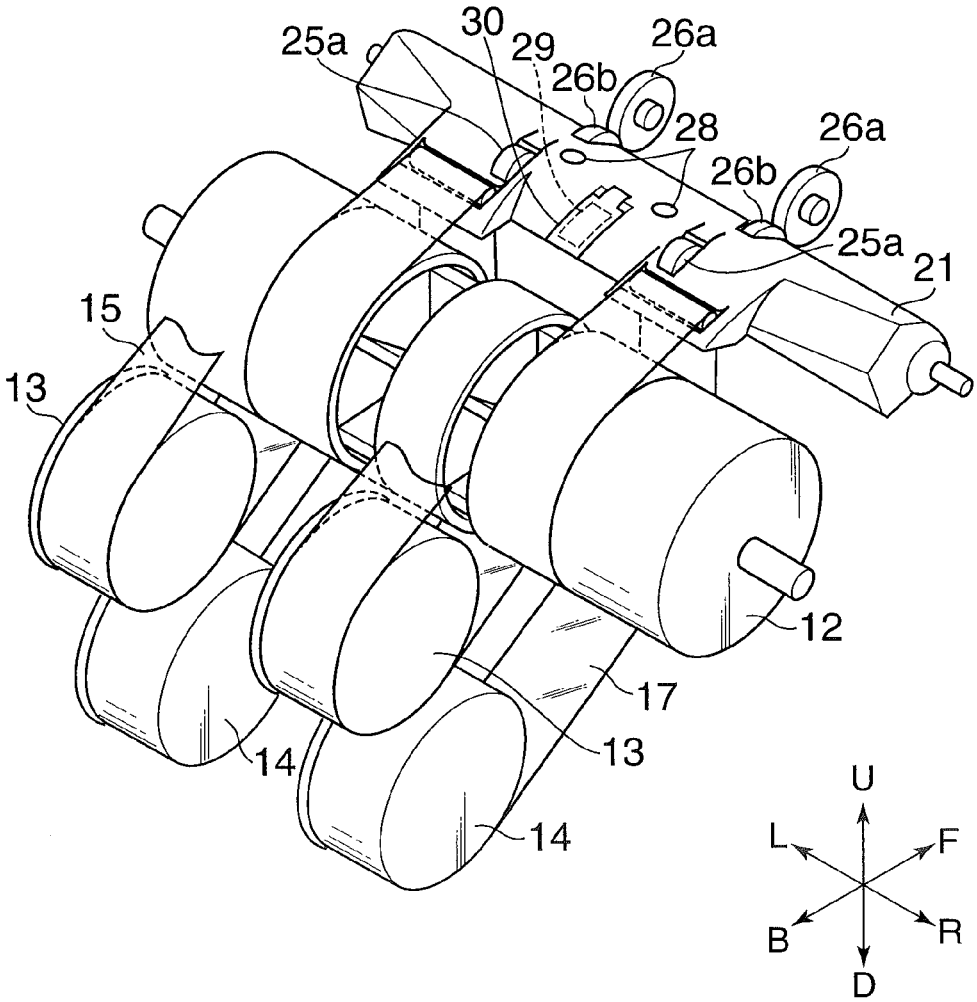
FIG. 10 is a perspective view schematically showing the structure of the temporary storage.

It is noted that the jam sensor 29 located in the rear end of the lower movable guide 21 is protected, for instance, by a semitransparent cover 30 being provided at the rear end of the lower movable guide 21 as shown in FIG. 10 and passing the optical axis 29*a*.

Next, with reference to flowcharts shown in FIGS. 11A and 11B, rewinding process procedure RT in the reset operation will be described according to the temporary storage 4. The rewinding process procedure RT is executed by the unit controller 4*a* of the temporary storage 4.

In the reset operation, if the residual sensor 27 detects that bills remain wounded in the temporary storage 4, the unit controller 4*a* of the temporary storage 4 starts the rewinding process procedure RT to shift itself to step SP1.

In step SP1, the unit controller 4*a* activates the delivering motor so as to rotate in the direction for rewinding the bills and shifts to next step SP2. At this moment, the delivering rollers 25*a* and 25*b* and conveying rollers 26*a* and 26*b* respectively start to rotate in the direction for rewinding bills.

In step SP2, the unit controller 4*a* activates the winding motor so as to rotate in the direction for rewinding the bills and shifts to next step SP3. At this moment, in addition to the delivering rollers 25*a* and 25*b* and conveying rollers 26*a* and 26*b*, the drum 12, upper reel 13 and lower reel 14 also start to rotate in the direction for rewinding the bills.

In step SP3, the unit controller 4*a* starts the ON monitoring of the jam sensor 29, and simultaneously starts time measurement, and then shifts itself to next step SP4.

In step SP4, the unit controller 4*a* determines whether or not a predetermined limited time having elapsed after the start of the ON monitoring of the jam sensor 29, i.e. whether to time out. The limited time thus set is to limit a term of the ON monitoring in order to prevent the drum 12 from continuously rotating, and thus may be set, for instance, equal to a period of time necessary for several dozens of rotation of the drums 12.

Figure 12A:
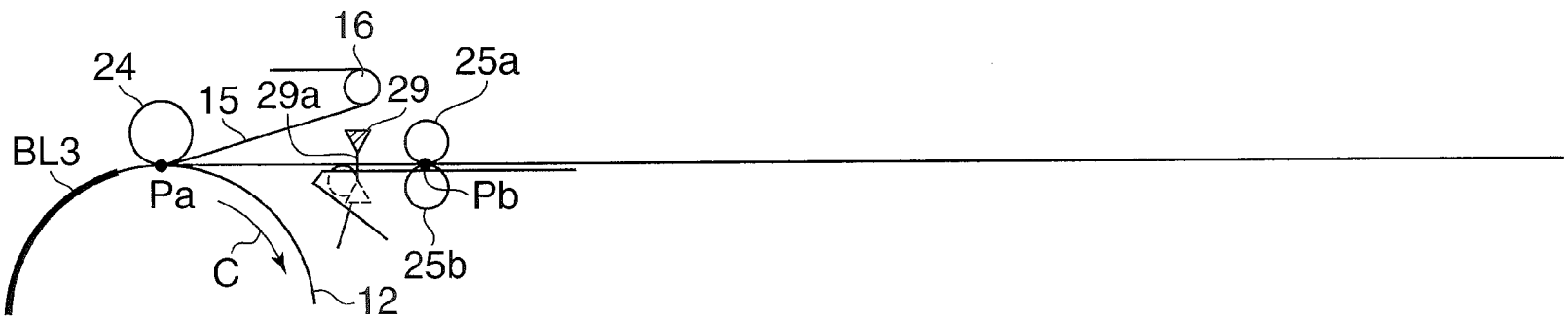
FIGS. 12A to 12C are schematic diagrams for use in describing a flow of an ON/OF monitoring by the jam sensor.
Figure 12B:
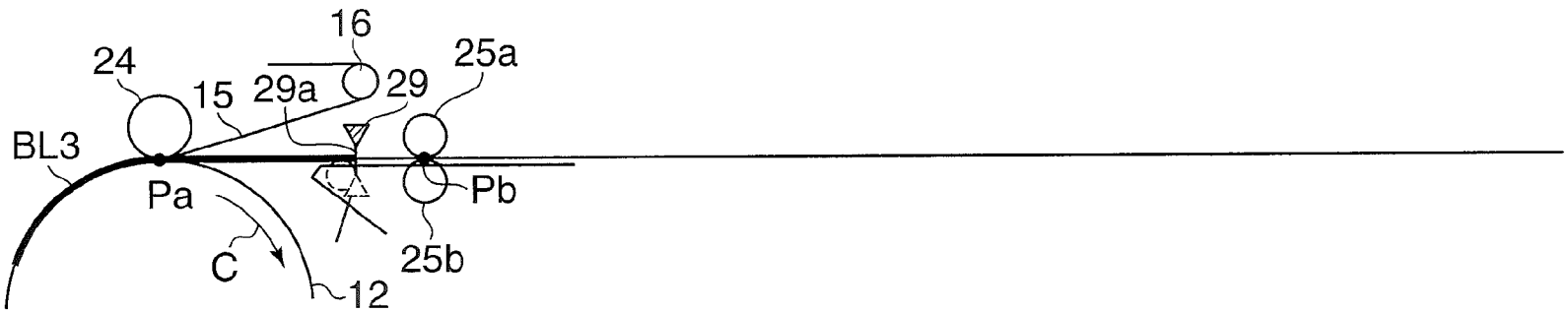

Here, for instance, if the top end of a bill BL3 arrives at the optical axis 29*a* of the jam sensor 29 as shown in FIG. 12B within a predetermined time after starting the rotation of the winding motor as shown in FIG. 12A to render the jam sensor 29 conductive, the unit controller 4*a* obtains an affirmative result (YES) in step SP4 and shifts itself to step SP5.

In step SP5, the unit controller 4*a* starts the OFF monitoring of the jam sensor 29, and simultaneously starts the time measurement again, then shifting to next step SP6.

In step SP6, the unit controller 4*a* determines whether or not a predetermined limited time having elapsed after the start of the OFF monitoring of the jam sensor 29, i.e. whether to time out. The limited time thus set is a reference term for use in detecting whether or not a bill normally passes the jam sensor 29. The limited time may be set a little bit longer than a bill passing time which depends upon the conveying speed of bills according to the rotation rate of the drum 12 and upon the length of bills in the conveying direction, e.g. the length of the shorter side where bills are conveyed in parallel to the shorter side.

Figure 12C:
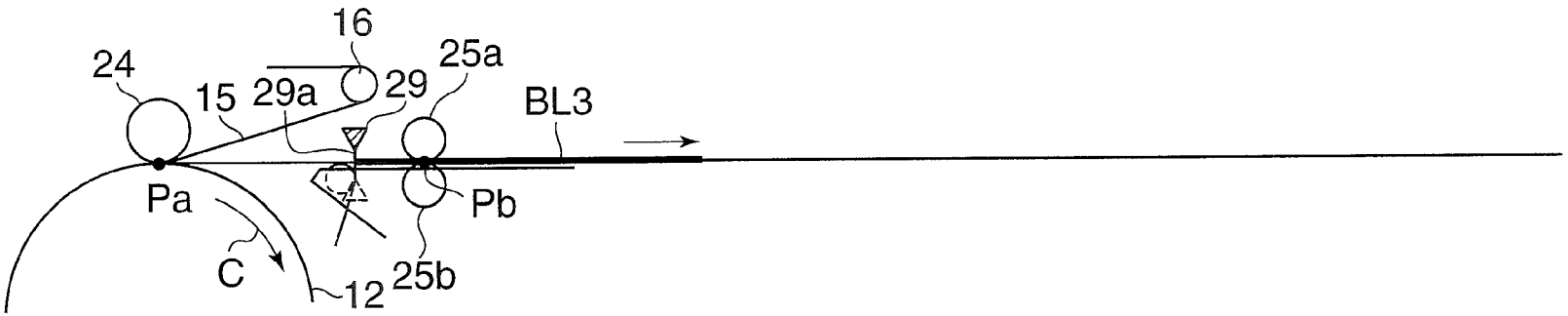

Here, for instance, if the rear end of the bill BL3 departs from the optical axis 29*a* of the jam sensor 29 as shown in FIG. 12C within a predetermined time after the arrival of the top end of the bill BL3 at the jam sensor 29 as shown in FIG. 12B to render the jam sensor 29 non-conductive, then the unit controller 4*a* obtains an affirmative result (YES) in step SP6 and shifts itself to step SP7.

In step SP7, the unit controller 4*a* determines by the residual sensor 27 whether or not bills still remain in the temporary storage 4. If an affirmative result (YES) is obtained in step SP7, the unit controller 4*a* returns to step SP3 again, and then starts the ON monitoring of the jam sensor 29, and simultaneously commences the time measurement again.

By contrast, if a negative result (NO) is obtained in step SP7, this means that all the remained bills have normally been rewound. Therefore, the unit controller 4*a* shifts to step SP8 to determine that all the remained bills have normally been rewound and shifts itself to next step SP9.

In step SP9, the unit controller 4*a* stops the winding motor and shifts to next step SP10. At this moment, the rotation of the drum 12, upper reel 13 and lower reel 14 are also stopped.

In step SP10, the unit controller 4*a* stops the delivering motor, and accordingly stops, in addition to the drum 12, upper reel 13 and lower reel 14, the delivering rollers 25*a* and 25*b* and conveying rollers 26*a* and 26*b*, thus normally completing the rewinding process procedure RT.

In above-described step SP4, however, if the limited time has elapsed after the start of the ON monitoring of the jam sensor 29, i.e. the timeout occurs, to get an affirmative result (YES), this means that the bill BL3 has not been rewound in spite of the elapse of the limited time. At this moment, the unit controller 4*a* shifts to step SP11 shown in FIG. 11B via a connector "a", to determine that there is a possibility of the apparatus malfunctioning, and in turn shifts to next step SP13.

In step SP13, the unit controller 4*a* stops the winding motor and shifts to next step SP14, and then ceases the delivering motor in step SP14. That causes to stop, in addition to the drum 12, upper reel 13 and lower reel 14, the delivering rollers 25*a* and 25*b* and conveying rollers 26*a* and 26*b*, thereby finishing the rewinding process procedure RT in error.

Figure 11A:
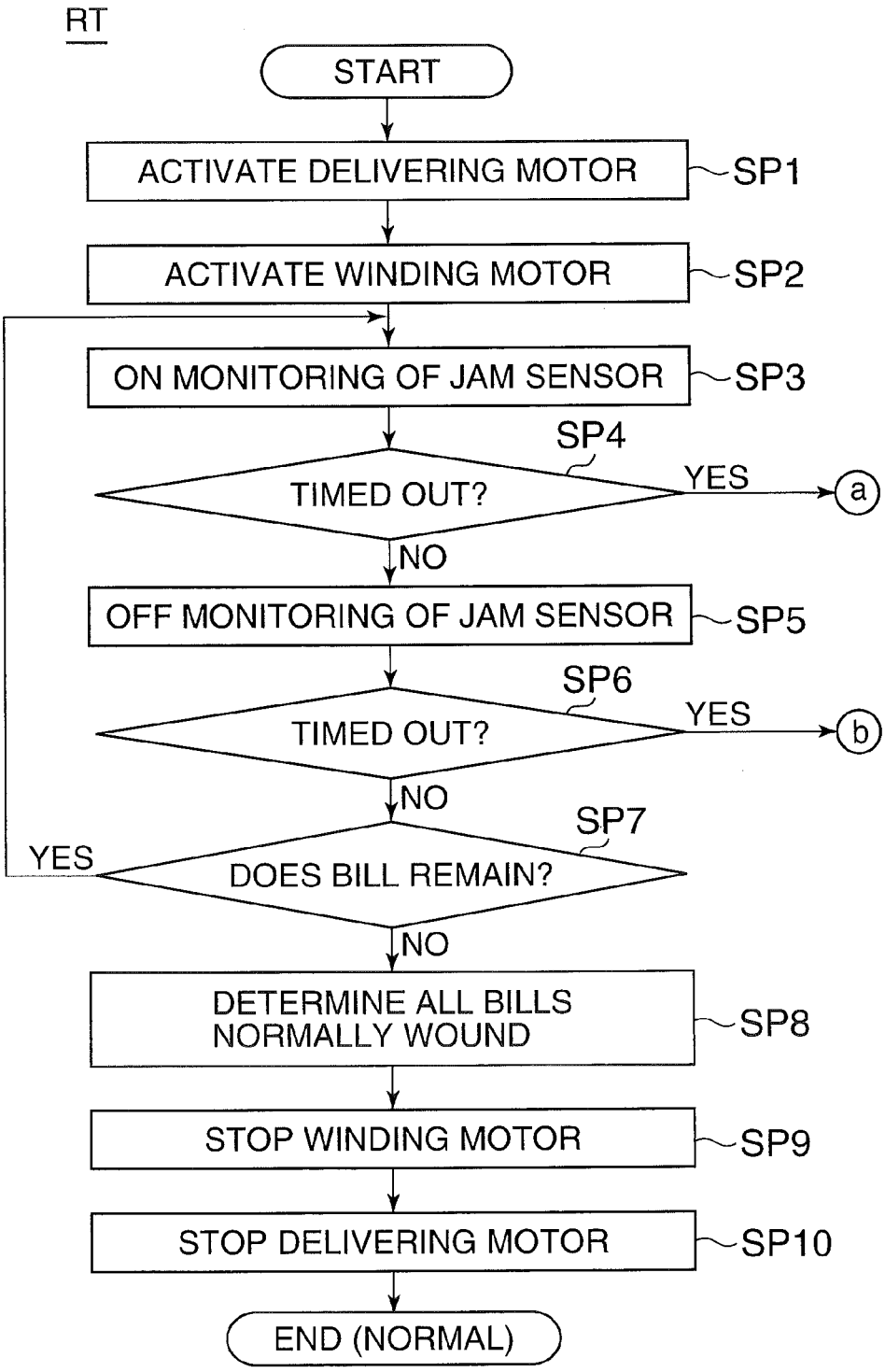
FIGS. 11A and 11B are flowcharts showing a rewinding process procedure by the unit controller of the temporary storage.
Figure 11B:
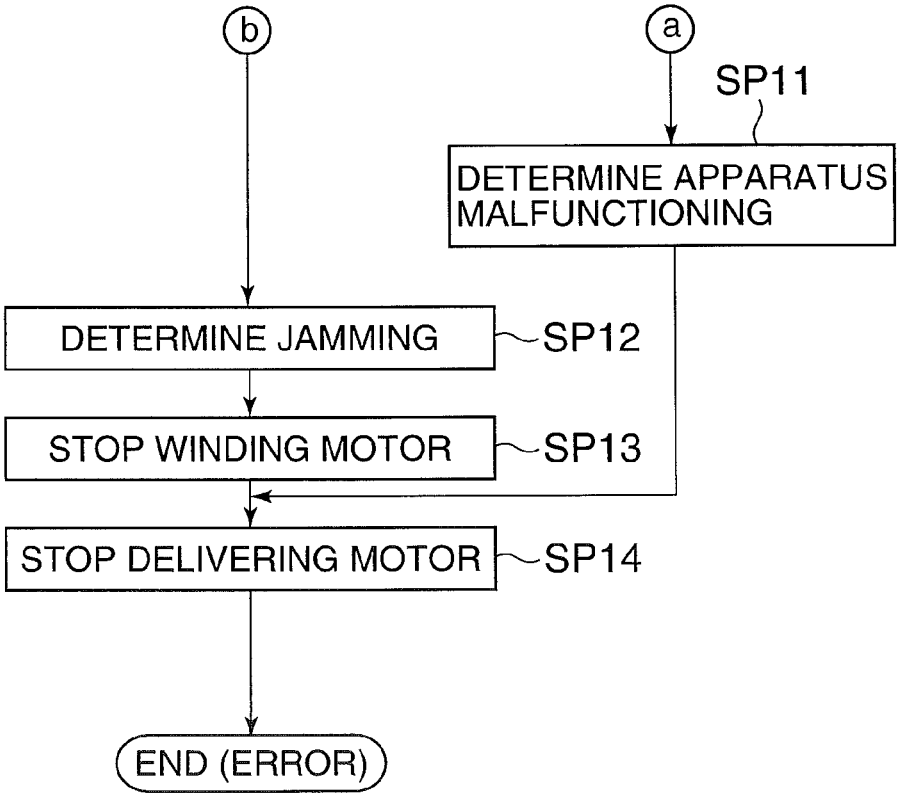
Figure 13:
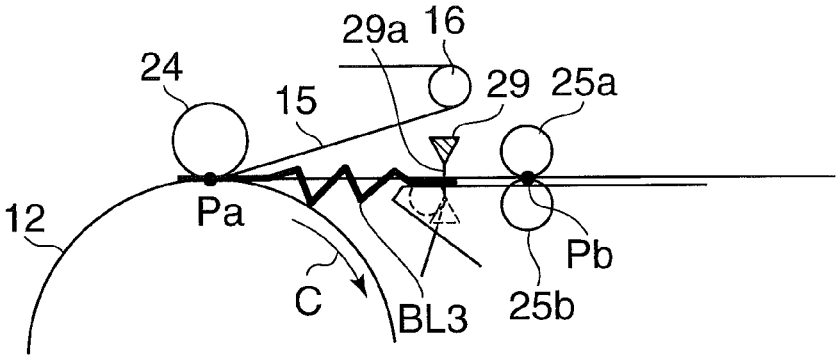
FIG. 13 is a schematic diagram for use in describing occurrence of a jam.

In above-described step SP6, FIG. 11A, if the limited time has elapsed after the start of the OFF monitoring of the jam sensor 29, i.e. the timeout occurs, to obtain an affirmative result (YES), this means that the bill BL3 does not pass the jam sensor 29 in spite of the elapse of the limited time, that is, for instance, as shown in FIG. 13, the bill jams between the winding start position Pa of the drum 12 and the clamp point Pb of the delivering rollers 25*a* and 25*b*. In response, the unit controller 4*a* shifts itself to step SP12, FIG. 11B, via a connector "b" to determine that the jam occurs, and then shifts to next step SP13.

In step SP13, the unit controller 4*a* stops the winding motor and shifts to next step SP14, and then disables the delivering motor in step SP14. Accordingly, in addition to the drum 12, upper reel 13 and lower reel 14, the delivering rollers 25*a* and 25*b* and conveying rollers 26*a* and 26*b* are also stopped, thereby finishing the rewinding process procedure RT in error. In accordance with the rewinding process procedure RT, the unit controller 4*a* carries out the rewinding in the reset operation.

In summary, the temporary storage 4 carries out, when rewinding bills in the reset operation, the ON/OFF monitoring by means of the jam sensor 29 without using a pulse count stored in winding. Accordingly, even when the relationship between a stored pulse count and a bill position becomes different from the actual state, it is possible to detect a jam occurring between the winding start position Pa of the drum 12 and the clamp point Pb of the delivering rollers 25*a* and 25*b*.

In the temporary storage 4, one device of the jam sensor 29 is arranged in the rear end of the lower movable guide 21 and the other device is arranged on the side of the upper movable guide 20 above the former so that the optical axis 29*a* of the jam sensor 29 passes between the upper face of the rear end of the lower movable guide 21 and the lower face of the upper movable guide 20 above it. In other words, the jam sensor 29 is arranged at a position where a jam is likely to occur and a jam, when occurring, can surely be detected.

Therefore, the temporary storage 4 can detect, by the jam sensor 29, a jam occurring between the winding start position Pa of the drum 12 and the clamp point Pb of the delivering rollers 25*a* and 25*b*.

In addition, the jam sensor 29 is positioned in the middle between the upper tape 15 and lower tape 17 on the left (L) and the upper tape 15 and lower tape 17 on the right (R) Accordingly, even when a wound bill is skewed and a corner of the bill is floated outside the upper tape 15 and lower tape 17 at the near side or outside the upper tape 15 and lower tape 17 at the far side, and passes the end of the upper face of the rear end of the lower movable guide 21, the temporary storage 4 does not erroneously detect a jam. That is, it is possible to correctly detect true jam.

In this manner, in accordance with the embodiment, the temporary storage 4 is free from erroneous detection that would have been caused by using a pulse count stored in the memory during winding when bills are rewound in the reset operation, and can thus correctly detect a jam between the drum 12 and the delivering rollers 25*a* and 25*b*. Thus, the temporary storage 4 can more securely detect the abnormality in bill winding in comparison with the prior art.

In the above-described embodiment, the present invention is applied to the temporary storage 4 adapted for winding bills around the drum 12 with the opposite lateral edges of bills caught by the four tapes 15 and 17 which are separately provided vertically and laterally and composed of a pair of upper tapes 15 and a pair of lower tapes 17 provided on the opposite sides with respect to the conveying direction of the bill.

The present invention may not be restricted by this, but advantageously applied to a variety of medium storing devices. For instance, the invention may be applied, about the apparatus main body 10, to other types of temporary storage, in which bills are wound while being held between two tapes, composed of an upper tape on the left (L) and an upper tape on the right (R) with respect to lateral direction, and a drum, or in which bills are wound while being held between one upper tape and a drum, or in which bills are wound around a drum while being held between a couple of tapes composed of an upper and a lower tape. The invention may also be applied to a temporary storage having three or more tapes provided with respect to the lateral direction.

Figure 14:
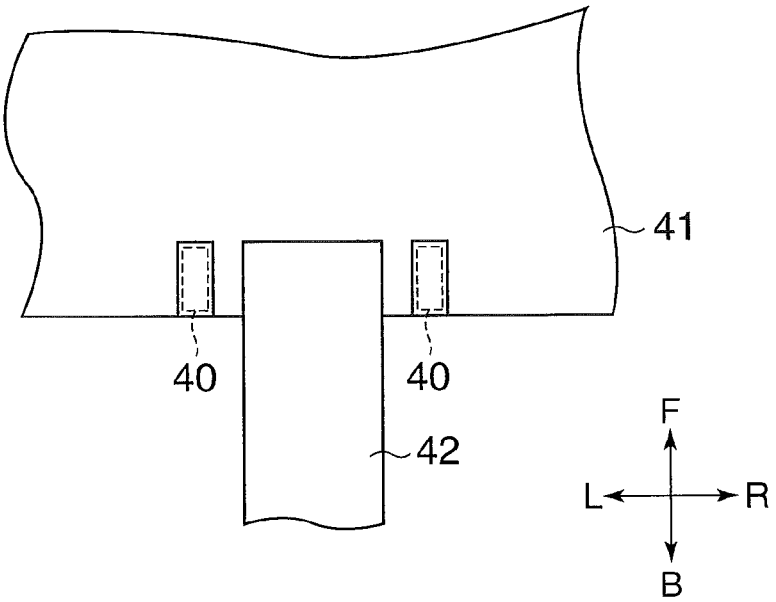
FIG. 14 is a partial plan view schematically showing the temporary storage to show the position of a jam sensor in accordance with an alternative embodiment.

For example, if only one tape is arranged on the upper side or two tapes are arranged with one on the upper and the other on the lower side, that is, if only one tape is arranged with respect to the lateral direction, as shown in FIG. 14, one device of the jam sensor 40 may be arranged in the rear end of a lower movable guide 41 and near a tape 42 in the width direction. In that case, the one device of the jam sensor 40 may be arranged near either of the left and right sides (L, R) of the tape 42 or arranged at both the left and right sides.

Also in the case where upper tapes are arranged with one on the left and the other on the right, or an upper tape and a lower tape are respectively arranged on the left and right, that is, where two tapes are arranged with respect to the lateral direction, that device may be arranged not only in the middle between the lateral tapes but also at both or either of the lateral sides with respect to each tape. Furthermore, if three tapes are arranged with respect to the lateral direction, that device may be positioned at both or either of the lateral sides with respect to each tape.

In other words, the one device of the jam sensor may be positioned in the rear end of the lower movable guide 201 between the tapes or near the tape in the width direction.

In addition, not only to this, for instance, if the tape is semitransparent allowing the optical axis of the jam sensor to pass through, the one device of the jam sensor may be positioned on the inner side of the tape so that the optical axis passes the tape.

If a plurality of jam sensors are provided, for instance, they may be configured so as to determine a jam when one of the plurality of jam sensors detects a jam or to determine a jam when a predetermined number of the sensors among the plurality of jam sensors detect a jam.

In the embodiment described above, one device of the jam sensor 29 is arranged in the rear end of the lower movable guide 201 and the other device is arranged on the side of the upper movable guide 20 above the one device. However, the other device may be arranged inside the upper movable guide 20. In the latter case, even when the upper movable guide 20 and lower movable guide 21 are turned, the optical axis of the jam sensor 29 is not shifted against them, thus making it possible to more surely detect a jam.

Further, not limitative to the above, the light emitting device and photosensitive device of the jam sensor 29 may be provided at any positions so long as the optical axis is arranged across the conveying path of bills between the winding start position Pa of the drum 12 and the clamp point Pb of the delivering rollers 25*a* and 25*b*. In such a case, for instance, the optical axis may be refracted by an optical system, such as a prism, thereby increasing degree of freedom of the positions of the light emitting device and photosensitive device.

Furthermore, the jam sensor 29 may not be restricted to a photoelectric sensor composed of a light emitting device and a photosensitive device, but in essential it may be any kinds of sensor so long as it is capable of monitoring bills between the winding start position Pa of the drum 12 and the clamp point Pb of the delivering rollers 25*a* and 25*b*.

Moreover, in the embodiment described so far, the jam sensor 29 is disposed between the winding start position Pa of the drum 12 and the clamp point Pb of the delivering rollers 25*a* and 25*b* and the delivering sensor 28 is disposed between the delivering rollers 25*a*, 25*b* and conveying rollers 26*a*, 26*b*. Not restrictive to that, the delivering sensor 28 may be omitted and the function of the delivering sensor 28 may be implemented by the jam sensor 29.

In such a configuration, except for the reset operation, i.e. in the normal operation, the jam sensor 29 is made operative also as the delivering sensor 28 as described with reference to FIGS. 5A to 8C, it is possible to implement the function of the delivering sensor 28 by the jam sensor 29. By contrast, in the reset operation, as described about the rewinding process procedure RT, it is possible to function the jam sensor 29. It is thus possible to simplify the configuration of the temporary storage 4 in proportion to the omission of the delivering sensor 28 to thereby decrease a manufacturing cost.

The above-described embodiment is configured to utilize the pulse motor for the winding motor to store a pulse count in the memory at the timing when the delivering sensor 28 is rendered conductive/non-conductive, and to determine, on the basis of the pulse count, at which position on the drum 12 bills are wound around.

That may not be restrictive, but a direct current (DC) motor and an encoder may be utilized for the winding motor instead of the pulse motor and a rotation angle obtained from an output of the encoder may be stored in the memory instead of a pulse count. In addition, not only to this, other types of motor than described above may be utilized for the winding motor so long as they have the mechanism thereof similar to the function.

In the above-described embodiment, when the bill is rewound in the reset operation, the ON/OFF monitoring by the jam sensor 29 is limited in terms of time. However, it is not restrictive, but, instead of the time, the number of rotations of the winding motor may be used for the limitation. In that case, a limit number of pulses indicating a limited rotation number may be set such that the ON/OFF monitoring may be carried out until a pulse number obtained from the winding motor reaches this limit pulse number.

In the above-described rewinding process procedure RT in step SP11, the unit controller 4*a* determines the possibility of occurrence of malfunction of the apparatus in step SP11 and detects a jam occurrence in step SP12. The unit controller 4*a* may be configured to transmit such a determination result, for instance, to the main controller of the automatic transaction apparatus 1 and the main controller may be configured to display the determination result as an error, for instance, on a display, not shown, for maintenance servicing and management. It is thus possible to appropriately notify servicing and management personnel what error occurs in the temporary storage 4.

Moreover, in the above-described embodiment, the pair of the delivering rollers 25*a* and 25*b* are disposed across the conveying path 23. However, not only to this, either one of the delivering rollers may be sufficient, and that single delivering roller may be rotated to have bills held against the upper movable guide 20 or lower movable guide 21 to send them. This similarly applies to the conveying rollers 26*a* and 26*b*.

In the above-described embodiment, the present invention is applied to the temporary storage 4 as a medium storing device. The present invention may not be restricted to this but may be applied to other types of temporary storage of a device handling a sheet-like or strip-like medium to be conveyed other than bills. In essence, the present invention may be applied to any kind of medium storing device capable of winding and storing a conveyed medium around a generally cylindrical carrier, such as a drum, and of rewinding and withdrawing the stored medium from the drum.

Furthermore, in the above-described embodiment, as a specific example, the temporary storage 4 as the medium storing device is provided with the jam sensor 29, which acts as a sensor in the monitor for monitoring bills between the winding start position Pa of the drum 12 and the clamp point Pb of the delivering rollers 25*a* and 25*b*, and the unit controller 4*a*, which acts as a controller of the monitor. However, this may not be limitative, but in place of them the temporary storage 4 may be provided with another sensor or controller so long as it acts similarly to the jam sensor 29 or the unit controller 4*a*.

In the above-described embodiment, the present invention is applied to the automatic cash transaction apparatus 1 as a medium processing apparatus. The present invention may not be restricted by this, but may be applied to various medium processing apparatuses, such as a copying machine, a vending machine or a ticket vending machine handling a medium other than bills so long as they may be provided with a medium storing device capable of winding and storing a medium around the drum, and of rewinding and withdrawing the stored medium from the drum.

The entire disclosure of Japanese patent application No. 2011-224973 filed on Oct. 12, 2011, including the specification, claims, accompanying drawings and abstract of the disclosure, is incorporated herein by reference in its entirety.

While the present invention has been described with reference to the particular embodiments, it is not to be restricted by the embodiments. It is to be appreciated that so-called those skilled in the art can change or modify the embodiments without departing from the scope and spirit of the present invention.

The invention claimed is:

1. A medium storing device comprising:

a drum winding a medium and storing the medium around a circumference face of the drum;

a delivering roller sending the medium coming from an inlet/outlet port for winding so as to send the medium to said drum, and returning the medium unwound from said drum to said inlet/outlet port for return;

a monitor monitoring a conveying path for the medium between a winding start position of said drum and said delivering roller, said monitor monitoring the conveying path regardless of a rotation amount of said drum obtained in winding, said monitor including a sensor, which has a light emitter emitting a light beam and an optical sensor receiving the light beam on an optical axis, and a controller, the optical axis being arranged across the conveying path, said sensor being rendered conductive or non-conductive in accordance with whether or not the optical axis is obstructed by the medium, said controller monitoring whether said sensor is conductive or non-conductive to thereby determine whether or not the medium on the conveying path is abnormal; and a guide guiding the medium from a vicinity of the inlet/outlet port to a vicinity of said drum, said delivering roller being arranged in a middle of said guide, the optical axis being arranged to pass a tip end of said guide near said drum.

2. The device in accordance with claim 1, further comprising a tape supporting the medium and winding the medium around said drum with the medium being pressed against the circumference face.

3. The device in accordance with claim 2, wherein two tapes as said tape are arranged with respect to a longitudinal direction of said drum so that said two tapes press one end and another end of the medium against said drum, thereby winding the medium together with said two tapes around said drum.

4. The device in accordance with claim 3, wherein the optical axis is arranged to pass between said two tapes.

5. The device in accordance with claim 2, wherein the optical axis is arranged to pass near said tape in a width direction of said tape.

6. The device in accordance with claim 1, wherein said controller determines whether or not the medium jams, according to whether or not the medium passes through the optical axis within a predetermined limit time.

7. The device in accordance with claim 6, wherein the predetermined limit time is selected on a basis of a conveying speed and a length in a conveying direction of the medium.

8. A medium processing apparatus comprising:

a drum winding a medium and storing the medium around a circumference face of the drum;

a delivering roller sending the medium coming from an inlet/outlet port to said drum for winding so as to send the medium to said drum, and returning the medium rewound unwound from said drum to said inlet/outlet port for return;

a monitor monitoring a conveying path for the medium between a winding start position of said drum and said delivering roller, said monitor monitoring the conveying path regardless of a rotation amount of said drum obtained in winding, said monitor including a sensor, which has a light emitter emitting a light beam and an optical sensor receiving the light beam on an optical axis, and a controller, the optical axis being arranged across the conveying path, said sensor being rendered conductive or non-conductive in accordance with whether or not the optical axis is obstructed by the medium, said controller monitoring whether said sensor is conductive or non-conductive to thereby determine whether or not the medium on the conveying path is abnormal; and a guide guiding the medium from a vicinity of the inlet/outlet port to a vicinity of said drum, said delivering roller being arranged in a middle of said guide, the optical axis being arranged to pass a tip end of said guide near said drum.

* * * * *